US008105016B2

(12) United States Patent
Butz et al.

(10) Patent No.: US 8,105,016 B2
(45) Date of Patent: Jan. 31, 2012

(54) DAMPING ARRANGEMENT FOR GUIDE VANES

(75) Inventors: Carsten Butz, Munich (DE); Werner Humhauser, Moosburg (DE); Patrick Wackers, Baldham (DE); Walter Waschka, Puchheim (DE); Moritz Wirth, Munich (DE)

(73) Assignee: MTU Aero Engines GmbH, Munich (DE)

( * ) Notice: Subject to any disclaimer, the term of this patent is extended or adjusted under 35 U.S.C. 154(b) by 1215 days.

(21) Appl. No.: 10/589,160

(22) PCT Filed: Feb. 4, 2005

(86) PCT No.: PCT/DE2005/000182
§ 371 (c)(1),
(2), (4) Date: Jun. 4, 2007

(87) PCT Pub. No.: WO2005/078242
PCT Pub. Date: Aug. 25, 2005

(65) Prior Publication Data

US 2008/0019836 A1 Jan. 24, 2008

(30) Foreign Application Priority Data

Feb. 11, 2004 (DE) ..... 10 2004 006 706

(51) Int. Cl.
*F01D 5/00* (2006.01)

(52) U.S. Cl. ..... 415/119; 415/209.4; 415/210.1

(58) Field of Classification Search ..... 415/119, 415/191, 209.4, 210.1
See application file for complete search history.

(56) References Cited

U.S. PATENT DOCUMENTS

| | | | | |
|---|---|---|---|---|
| 3,326,523 | A | 6/1967 | Bobo | |
| 4,285,633 | A * | 8/1981 | Jones | 415/191 |
| 4,897,021 | A * | 1/1990 | Chaplin et al. | 415/173.7 |
| 5,601,407 | A * | 2/1997 | Humhauser | 415/209.2 |
| 6,139,264 | A * | 10/2000 | Schilling | 415/174.2 |
| 7,291,946 | B2 * | 11/2007 | Clouse et al. | 310/51 |
| 7,334,996 | B2 * | 2/2008 | Corbin et al. | 416/221 |

FOREIGN PATENT DOCUMENTS

| | | |
|---|---|---|
| EP | 1 441 108 A2 | 7/2004 |
| JP | 11 050807 | 2/1999 |

* cited by examiner

*Primary Examiner* — Edward Look
*Assistant Examiner* — Ryan Ellis
(74) *Attorney, Agent, or Firm* — Crowell & Moring LLP

(57) ABSTRACT

A damping arrangement for guide vanes, in particular for guide vanes of a gas turbine or an aircraft engine, is disclosed. Referring to this damping arrangement, the radially external ends of the guide vanes of a guide vane grid or a guide vane ring are mounted to a housing. The radially internal ends of the guide vanes form an inner shroud. At least one seal bearing is mounted to the inner shroud of the guide vanes. At least one spring element is installed between the inner shroud of the guide vanes and the, or each, seal bearing. The, or each, spring element is configured as a leaf spring.

3 Claims, 3 Drawing Sheets

DAMPING ARRANGEMENT FOR GUIDE VANES

This application claims the priority of International Application No. PCT/DE2005/000182, filed Feb. 4, 2005, and German Patent Document No. 10 2004 006 706.6, filed Feb. 11, 2004, the disclosures of which are expressly incorporated by reference herein.

BACKGROUND AND SUMMARY OF THE INVENTION

The invention relates to a damping arrangement for guide vanes, in particular for guide vanes of a gas turbine or an aircraft engine.

Gas turbines consist of several assemblies, for example, among other things, a fan, a combustion chamber, preferably several condensers, as well as several turbines. Referring to the preferably several turbines, these are one high-pressure turbine and one low-pressure turbine; referring to the several condensers, these are one high-pressure condenser, as well as one low-pressure condenser. Inside a turbine, as well as inside a condenser of a gas turbine, several guide vane rings are arranged in a row in axial direction or in flow direction, in which case each guide vane ring comprises guide vanes distributed over its circumference. Between each two adjacent guide vane rings, respectively one rotor blade ring is provided, this latter rotor blade ring comprising several rotor blades. The rotor blades are associated with a rotor and rotate, together with the rotor, relative to a stationary housing, as well as relative to the also stationarily configured guide vanes of the guide vane rings.

In particular, the guide vanes of compressors of a gas turbine are subject to vibrations during operation of the gas turbine, so that the guide vanes must be damped in order to avoid damage to the guide vanes. Prior art has already disclosed the damping of guide vanes on their inner shroud, in that a spring element is installed in a hollow space between the inner shroud of the guide vanes and a seal bearing. Referring to prior art, in so doing, C-shaped springs are used, the springs having a relatively large radial design height. As a result of this, the radial dimension of the gas turbine is enlarged. Furthermore, the manufacture of prior art spring elements is relatively complex, and, due to bending operations required in the course of the manufacture of the spring elements, they are subject to tolerances. This is an overall disadvantage.

Considering this, the object of the present invention is to provide a novel damping arrangement for guide vanes, in particular for the guide vanes of a gas turbine or of an aircraft engine.

In accordance with the invention the, or each, spring element is configured as a leaf spring, in which case the, or each, spring element configured as a leaf spring exhibits a minimal radial extension.

Within the meaning of the present invention, it has been suggested that leaf springs be used as spring elements. The leaf springs are clamped between the inner shroud of the guide vanes and the, or each, seal bearing. This results in a clear reduction of the radial design space required for damping and thus in a clear reduction of the radial dimensions of the gas turbine. Such spring elements configured as leaf springs can be manufactured in a cost-effective manner and are less subject to tolerances than the C-shaped spring elements used for damping in prior art.

Preferably, the, or each, spring element configured as a leaf spring is clamped between the inner shroud of the guide vanes and the, or each, seal bearing, in which case the leaf spring's central abutment section abuts against the, or each, seal bearing and the leaf spring's two lateral abutment sections abut against the inner shroud of the guide vanes. Also, it is possible that the leaf spring's central abutment section abuts against the inner shroud of the guide vanes and the leaf spring's two lateral abutment sections abut against the, or each, seal bearing.

Referring to an advantageous development of the invention, the, or each, spring element configured as a leaf spring, comprises several leaf spring sections divided by slits, in which case each inner shroud of each guide vane is associated with such a leaf spring section, abutting against this leaf spring section.

BRIEF DESCRIPTION OF THE DRAWINGS

Preferred developments of the invention result from the description hereinafter. Examples of the invention, without being restricted thereto, are explained in detail with reference to the drawings. They show in.

DETAILED DESCRIPTION OF THE DRAWINGS

Figure 1:
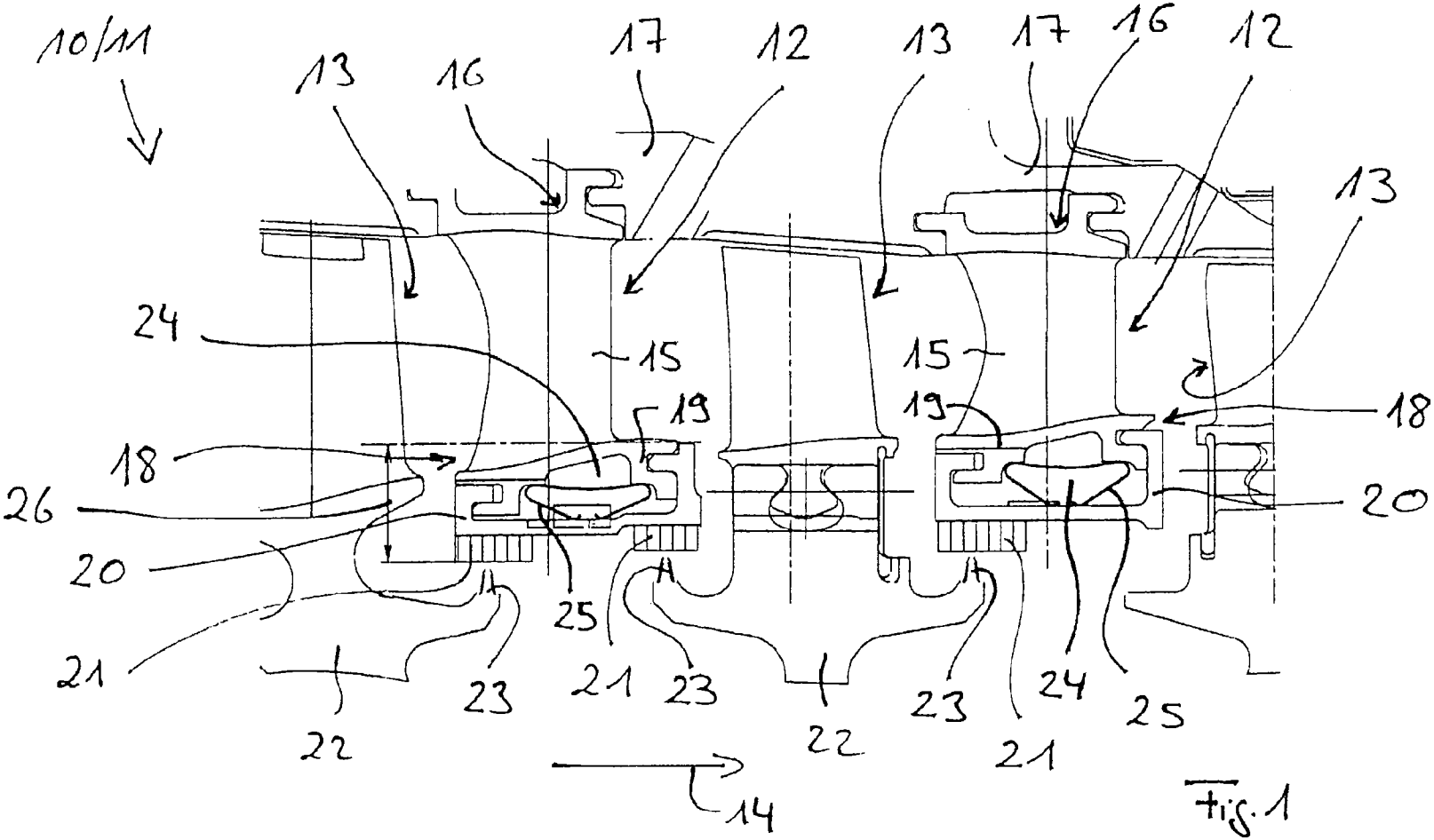
fig. 1 PRIOR ART
FIG. 1 illustrates a damping arrangement for guide vanes of a gas turbine, i.e., an aircraft engine, in accordance with prior art.

FIG. 1 is a sectional view of a condenser 10 of a gas turbine 11, in the region of two guide vane rings 12, as well as three rotor blade rings 13. Viewed in axial direction or in flow direction (arrow 14), guide vane rings 12 and rotor blade rings 13 are alternately arranged.

Each of the guide vane rings 12 consists of several guide vanes 15 arranged in circumferential direction at a distance from each other. The guide vanes 15 of the guide vane rings 12 are mounted on a radially external end 16 to a housing 17 of the condenser 10. On a radially internal end 18, the guide vanes 15 of the guide vane rings 12 form an inner shroud 19. At least one seal bearing 20 for the seal elements 21 is mounted to the inner shrouds 19 of the guide vanes 15. The seal elements 21 are configured as honeycomb seals which interact with seal fins 23 associated with rotor disks 22.

Referring to FIG. 1, prior art has disclosed damping the guide vanes 15 of the guide vane rings 12 on the inner shrouds 19 with respect to vibration stress in that a spring element 25 is positioned in a hollow space 24 located between the inner shrouds 19 of the guide vanes 15 and the, or each, seal bearing 20. Referring to prior art, this spring element 25 is configured as a C-shaped spring, which results in a relatively large radial design in the region of the inner shroud 19. Referring to FIG. 1, the radial design height in the region of the inner shroud 19, as well as the seal bearing 20, is indicated by a double arrow 26. Such a large radial design height in the region of the inner shroud results in a radially large design height of the entire gas turbine. This is disadvantageous. Furthermore, referring to prior art, the known C-shaped spring elements are subject to tolerances and thus imprecise.

Figure 2:
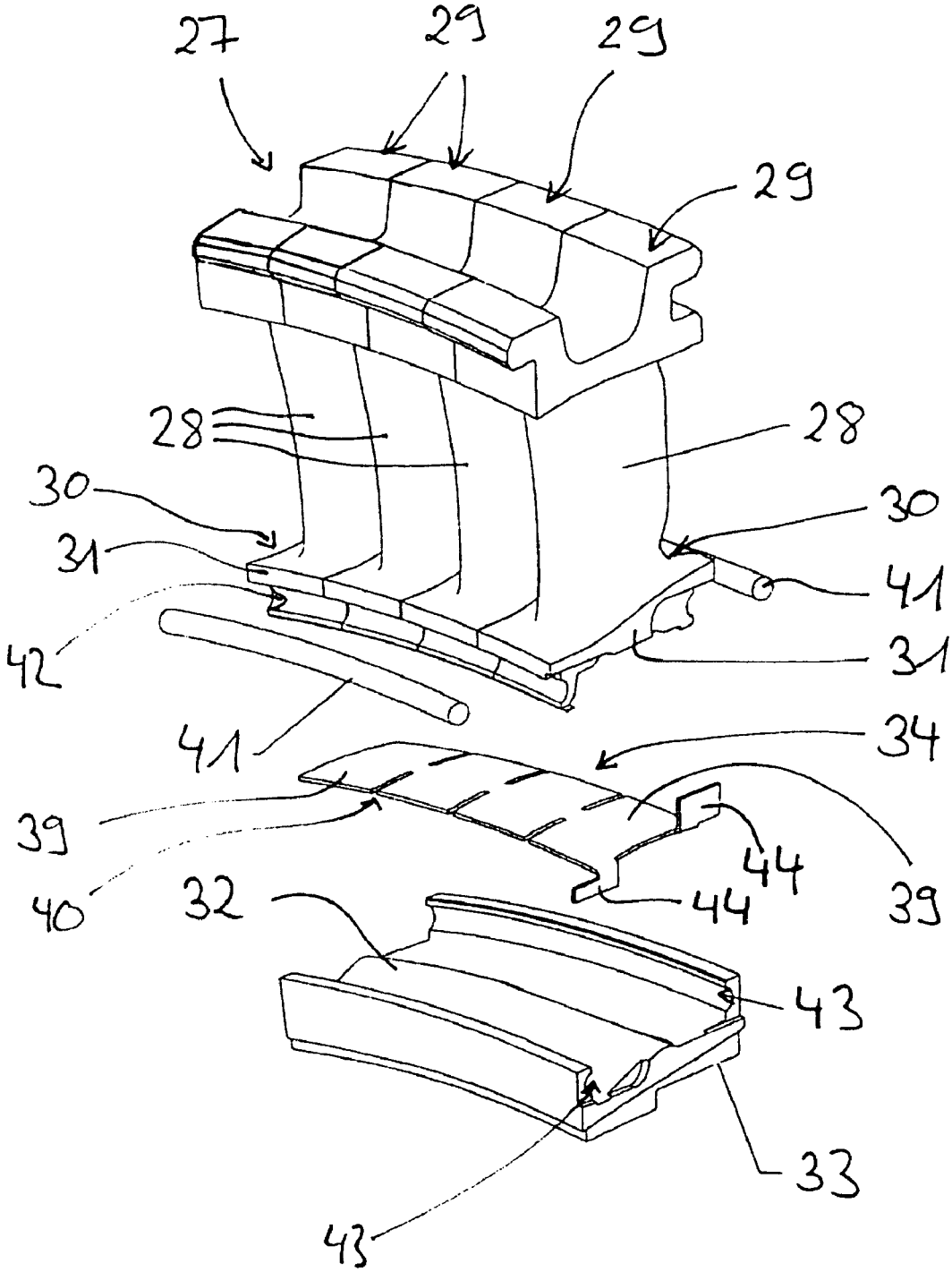
FIG. 2 is an exploded view of a damping arrangement for guide vanes of a gas turbine, i.e., an aircraft engine, within the meaning of the present invention.
Figure 3:
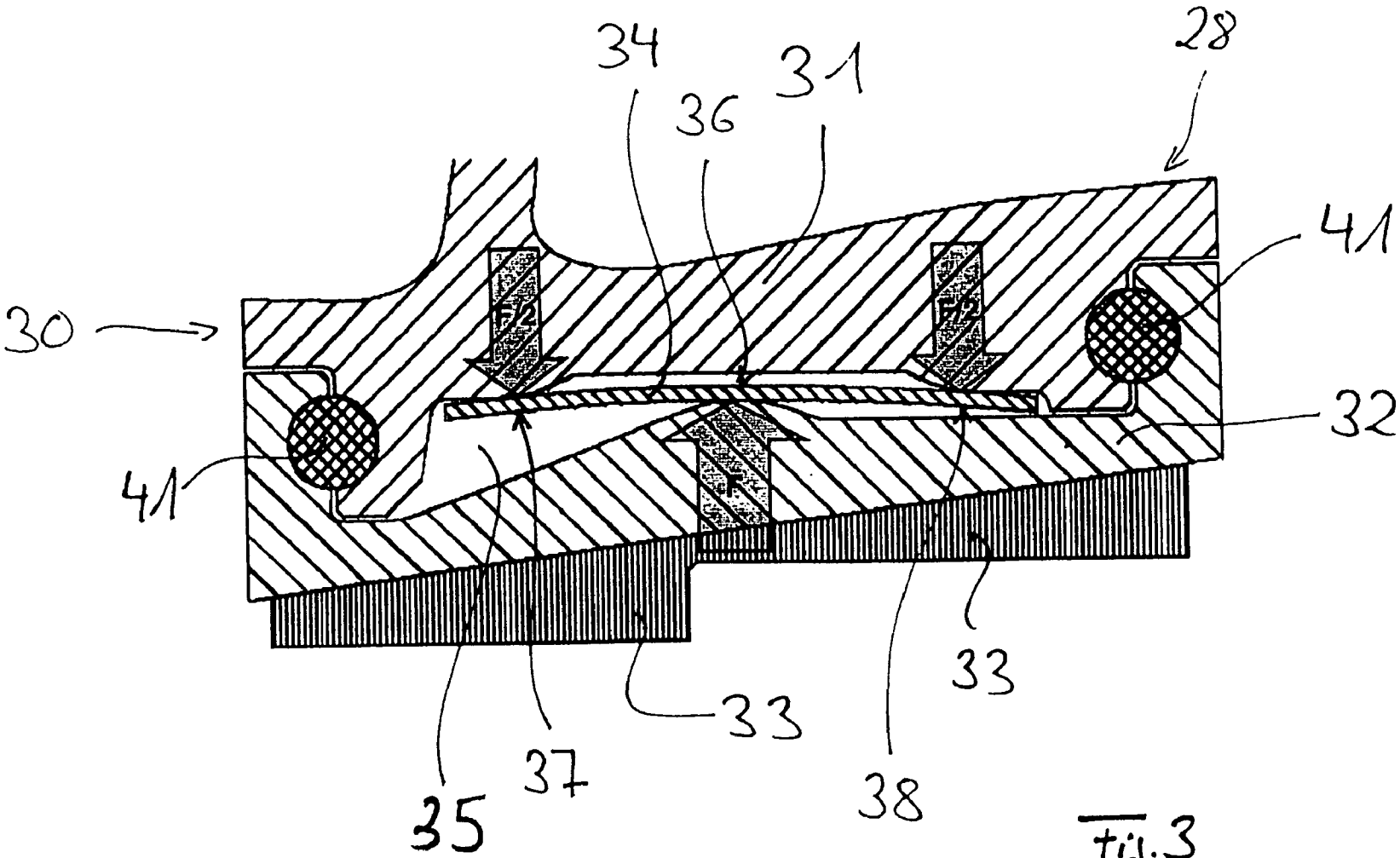
FIG. 3 is an assembled view of a section of the damping arrangement as in FIG. 2 of the region of the inner shroud of a guide vane.

Hereinafter, referring to FIGS. 2 and 3, the inventive damping arrangement will be described in greater detail, in which case FIG. 2 represents an exploded view of the damping arrangement, and FIG. 3 represents a cross-section through the inventive damping arrangement in the region of the inner shroud of a guide vane.

FIG. 2 shows a sectional view of a guide vane ring 27 in the region of four guide vanes 28. A radially externally abutting end 29 of the guide vanes 28 is used to mount the guide vanes to a housing of the gas turbine, which is not shown in FIG. 2. Referring to a radially internally located end 30 of the guide vanes 28, the guide vanes form an inner shroud 31. A seal bearing 32 for the seal elements 33 can be mounted to the four guide vanes 28.

Within the meaning of the present invention, it has been suggested to provide at least one spring element 34 configured as a leaf spring between the inner shroud 31 of the guide vanes 28 and the seal bearing 32 in order to achieve a damping of the guide vanes 28 in the region of the inner shrouds 31. Referring to FIG. 3, the spring element 34 configured as a leaf spring is positioned in a hollow space 35 between the inner shroud 31 and the seal bearing 32. Due to the minimal radial extension of the spring element 34 configured as a leaf spring, the hollow space 35 may also be embodied in a design having minimal radial height, so that, overall, the radial design height of the gas turbine is reduced.

As can be learned from FIG. 3, the spring element 34 is clamped between the inner shrouds 31 of the guide vanes 28 and the seal bearings 32 in such a manner that the spring's central abutment section 36 abuts against the seal bearing 32 and the spring's two lateral abutment sections 37 and 38 abut, or are in contact with, the inner shroud 31. Consequently, within the meaning of the arrows of FIG. 3, damping forces caused by vibrations act on the spring element 34. It should be noted that the abbreviation F in FIG. 3 stands for "Force." At this point it should be pointed out that the spring element 34 can also be clamped in exactly the reverse manner between the inner shrouds 31 of the guide vanes 28 and the seal bearing 32, namely, in such a manner that the central abutment section 36 of the spring element 34 abuts against the inner shroud 31, and that the two lateral abutment sections 37 and 38 abut against the seal bearing 32.

Referring to FIG. 2, the spring element 34 configured as the leaf spring comprises—in the depicted embodiment—more than four leaf spring sections 39 which are separated from each other by slits 40. Consequently, such a leaf spring section 39 is positioned in the region of each inner shroud 31 of each guide vane 28. Consequently, each guide vane 28 is individually damped in the region of the respective inner shroud 31. As can be learned from FIG. 2, the individual leaf spring sections 39 are separated from each other by respectively two slits 40, each of the two slits 40 extending from a different side into the spring element 34. The slits 40, which extend from different sides into the spring element 34 and which separate two adjacent leaf spring sections 39 from each other, end at a distance from each other, so that, between the two slits 40, a connecting strip remains between two leaf spring sections 39.

Referring to FIGS. 2 and 3, the inventive seal arrangement additionally comprises securing elements 41, which extend in circumferential direction and are located between the inner shrouds 31 of the guide vanes 28 and the seal bearing 32. The securing elements 41 are configured as securing wires and—viewed in cross-section—extend laterally next to the, or each, spring element 34 that is configured as a leaf spring. The securing elements 41 are guided in appropriate cutouts 42 and 43, respectively, inside the inner shroud 31 or the seal bearing 32. On its one end, the spring element 34 has angled sections 44 that act as securing tabs and fix the securing elements 41 in position.

Within the meaning of the present invention, a particularly advantageous design of a damping arrangement for the guide vanes of a gas turbine is provided. The radially minimal design height, as well as the easy manufacture of the spring elements, are particularly advantageous. Considering their uninstalled and thus relaxed state, the spring elements are configured as a simple, flat metal sheet. Therefore, the manufacture of the, or each, spring element does not require any bending. The spring forces or the deformation of the, or each, spring element is determined, among other things, by the contour of the inner shroud of the guide vanes and by the contour of the, or each, seal bearing.

The invention claimed is:

1. A damping arrangement for guide vanes, wherein radially external ends of the guide vanes of a guide vane grid or a guide vane ring are mounted to a housing, wherein radially internal ends of the guide vanes form an inner shroud, wherein at least one seal bearing is mounted to the inner shroud of the guide vanes, wherein at least one spring element is installed between the inner shroud of the guide vanes and the, or each, seal bearing, wherein the, or each, spring element is configured as a leaf spring, and wherein the, or each, spring element configured as a leaf spring has at least one angled section which acts as a securing tab for a securing element.

2. A damping arrangement for a guide vane ring of a gas turbine engine, comprising:

a guide vane ring including a first and a second guide vane, wherein a radially internal end of each of the first and second guide vanes forms an inner shroud;

a seal bearing mounted to the inner shrouds of the first and second guide vanes; and a spring element disposed between the inner shrouds and the seal bearing, wherein the spring element is a leaf spring;

wherein the leaf spring includes a first section and a second section, wherein the first section and the second section define a slit between the first and second sections;

and wherein the slit extends from a first side and a second side of the leaf spring and wherein the slit does not extend continuously along a width of the leaf spring between the first and second sides of the leaf spring.

3. A damping arrangement for a guide vane ring of a gas turbine engine, comprising:

a guide vane ring including a first and a second guide vane, wherein a radially internal end of each of the first and second guide vanes forms an inner shroud;

a seal bearing mounted to the inner shrouds of the first and second guide vanes;

a spring element disposed between the inner shrouds and the seal bearing, wherein the spring element is a leaf spring; and a securing element disposed between the inner shrouds and the seal bearing and wherein the leaf spring includes a radially extending tab on a circumferential end of the leaf spring and further wherein the securing element engages with the tab.

* * * * *